United States Patent [19]

Bell

[11] 4,450,768

[45] May 29, 1984

[54] SHAPED CHARGE AND METHOD OF MAKING IT

[75] Inventor: William T. Bell, Sugarland, Tex.

[73] Assignee: Schlumberger Technical Corporation, Houston, Tex.

[21] Appl. No.: 479,063

[22] Filed: Mar. 25, 1983

Related U.S. Application Data

[63] Continuation of Ser. No. 224,588, Jan. 12, 1981, abandoned.

[51] Int. Cl.[3] ..... F42B 3/08

[52] U.S. Cl. ..... 102/307; 86/1 R; 86/20 R; 86/20 B; 175/4.6; 264/3 R

[58] Field of Search ..... 86/1 R, 20 R, 20 B, 86/20 V; 102/306, 307, 310; 175/4.6; 264/3 R

[56] References Cited

U.S. PATENT DOCUMENTS

| | | | |
|---|---|---|---|
| 2,425,005 | 8/1947 | Rechel | 264/3 R X |
| 3,650,212 | 3/1972 | Bauer | 175/4.6 |
| 3,907,947 | 9/1975 | Neuhaus et al. | 86/1 R X |

OTHER PUBLICATIONS

Strunk et al., United States Published Application B387,039, Jan. 28, 1975.

*Primary Examiner*—Leland A. Sebastian

[57] ABSTRACT

The detonating bore in the rear wall of a shaped charge case is outwardly convex. A powdered explosive is compacted into the case through the open front opposite the detonating bore, causing the portion which enters the convex end of the bore from within the case to be less compacted and less dense, for increased sensitivity and more reliable detonation.

8 Claims, 3 Drawing Figures

FIG. 1
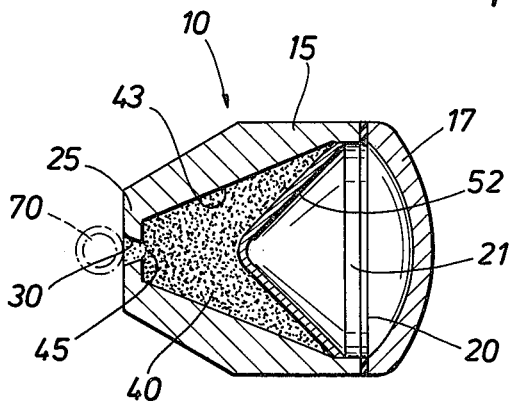
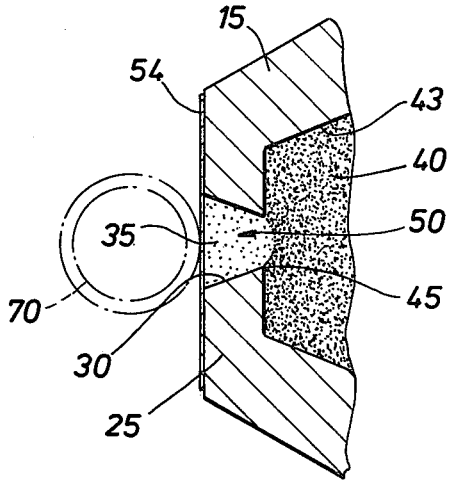
FIG. 2
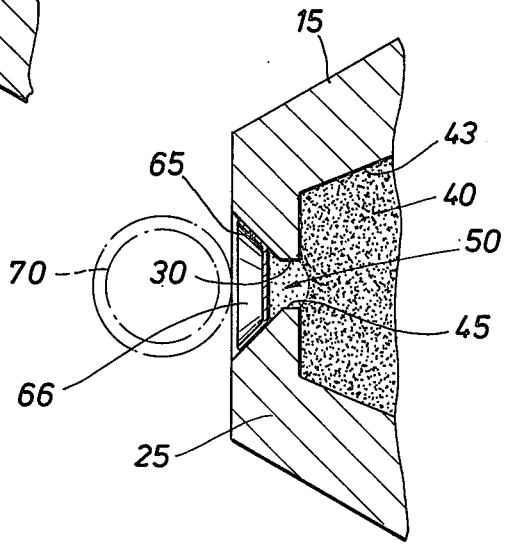
FIG. 3

SHAPED CHARGE AND METHOD OF MAKING IT

This is a continuation of application Ser. No. 224,588 filed Jan. 12, 1981 now abandoned.

BACKGROUND OF THE INVENTION

This invention relates to shaped charges, and more particularly to a method for fabricating more sensitive and more reliable shaped charges for use in perforating earth formations traversed by a wellbore.

Shaped charges of this type use high energy explosives which require high-order detonation. Often, for more reliable detonation, a primer explosive is placed between the primary detonator and the high-order shaped charge explosive material. The primer explosive, which is more easily detonated, provides the high-order detonation necessary for the shaped charge itself.

It has also been recognized that, for a particular explosive, its detonation sensitivity is governed to some extent by its grain size, its degree of compaction and confinement and, of course, the geometry of its container. These factors have been exploited in some shaped charges by making the explosive material less compacted in the vicinity of the detonator, to improve the sensitivity.

Both of these prior art approaches, however, involve manufacturing compromises. When different explosive compounds are used for the primer and for the high-order explosive, more steps must usually be added to the manufacturing process. If the two different explosive compounds are compacted in a single step, the primer material is also compressed to a high density, which typically degrades its sensitivity. When varying densities are provided, either with multiple or single explosives, special procedures and/or additional manufacturing steps have been necessary to provide the differing densities required at the several locations in the shaped charge.

An obvious disadvantage of prior art variable density solutions is the additional expense caused by the more complicated manufacturing processes. Another important disadvantage is due to the material itself: the less these high powered explosives are handled, the better. For these reasons, a need still remains for a direct, preferably one-step method for compacting a shaped charge explosive into its case in a highly dense configuration while simultaneously providing a lower density, more sensitive and more reliable detonation region.

SUMMARY OF THE INVENTION

Briefly, the present invention meets the above needs and purposes with a method for fabricating a shaped charge in which the hollow case for the charge has an outwardly flaring convex end in a detonating bore in the rear wall of the hollow case, opposite the front or open end, the outwardly convex end opening away from the interior of the case. The explosive powder material is then loaded into the case entirely through the open front end and compacted against the rear wall of the case. A portion of the explosive enters the detonating bore, but due to the outwardly convex shape thereof, the portion entering the convex end is less compacted and less dense than the remainder of the explosive within the hollow case. Basically, the explosive tends to bridge across the narrower portion of the detonating bore as the explosive is being compacted into the hollow case. The reduced density material in the outwardly convex end is thus more sensitive to detonation, and the increased sensitivity provides for better and more reliable detonation of the shaped charge.

In the preferred embodiment the convex end of the detonating bore is an essentially conical cavity which extends entirely through the rear wall of the hollow case. A thin aluminum disk may be adhesively secured across the outside of the rear wall to retain the less compacted explosive within the conical cavity.

It is therefore an object of the present invention to provide an improved method for fabricating a shaped charge having increased sensitivity for better and more reliable detonation; a method in which a single compacting step provides lower density explosive material in the detonation region; in which a hollow case has a detonating bore formed therein with an outwardly convex end to produce a region of less compacted explosive material when the explosive is loaded through the open front end of the hollow case; and to accomplish the above objects and purposes in an inexpensive, reliable and versatile configuration readily suited for use in many diverse shaped charge configurations.

Other objects and advantages of the invention will be apparent from the following description, the accompanying drawings and the appended claims.

BRIEF DESCRIPTION OF THE DRAWINGS

FIG. 1 is a cross-sectional view of a shaped charge fabricated according to the present invention;

FIG. 2 is an enlarged fragmentary cross-sectional view of the rear wall portion of the FIG. 1 shaped charge, showing one form of rear wall closure; and FIG. 3 is a view similar to FIG. 2 of another embodiment of the shaped charge and another type of rear wall closure.

DESCRIPTION OF THE PREFERRED EMBODIMENTS

With reference to the drawings, FIG. 1 shows a shaped charge 10 constructed according to the present invention. Charge 10 includes a case 15 having a cover 17 across the front 20 and across the front opening 21 thereof. On the opposite end of case 15 is a rear wall 25 having a detonating bore 30 formed therein. In the preferred embodiment, bore 30 extends entirely through the rear wall 25, although it could also extend only part way through, and has an outwardly convex conical end cavity 35 formed therein.

When case 15 is loaded with an explosive powder material 40 such as RDX, by filling it all through the front opening 21 and then compacting it through the front opening 21 into the hollow interior 43 and toward and against the rear wall 25 of the case 15, a portion of the explosive 40 will, of course, enter the detonating bore 30. However, it will tend to bridge in the neck 45 of the bore caused by the outwardly opening conical shape of the conical cavity 35, resulting in a less dense region 50 at the rear of the detonating bore 30. The shaped charge is then completed by inserting a hollow, frusto-conical metallic liner 52 through opening 21 in the front 20 of case 15, and over the compressed explosive 40. Cover 17 is then optionally secured across front opening 21, and the explosive in bore 30 is retained by a self-adhesive disk 54 applied across the conical cavity opening on the rear wall 25 (FIG. 2).

FIG. 3 illustrates a second embodiment of the invention in which the conical cavity 65 does not extend the entire length of the detonating bore 30, but is in only the rear portion thereof. It is closed by a self-adhesive plug 66 inserted partially into the cavity 65.

As may be seen, therefore, the present invention has numerous advantages. It is uncomplicated and can be fabricated with but a single compressing step for the explosive material. A homogeneous explosive material can be used, or a primer explosive powder can be loaded first, followed by the high order explosive powder, before the powders are compressed. When the explosive material is compressed into the hollow interior of the shaped charge case, it automatically forms a lower density region in the detonating bore for increased sensitivity and better and more reliable detonation of the shaped charge. The explosive in the detonating bore may then be detonated by the usual external detonator, such as a detonating cord 70 secured adjacent the conical cavity at the rear wall 25 of the shaped charge. The invention is thus economical, efficient, and versatile, and readily lends itself to use in diverse shaped charge configurations.

While the methods described herein constitute preferred embodiments of this invention, it is to be understood that the invention is not limited thereto, and that changes may be made therein without departing from the scope of the invention.

I claim:

1. A method for fabricating a shaped charge, comprising:

(a) forming a hollow case having a rear wall and an open end opposite the rear wall, (b) forming a detonating bore in the rear wall of the hollow case, (c) forming an outwardly convex end in the detonating bore, (d) loading explosive powder material into the case substantially only through the open end thereof, and (e) compacting the explosive material within the case into a shaped charge, through the open end thereof and toward and against the rear wall thereof, to cause a portion of the explosive to enter the detonating bore and the convex end thereof and be less compacted and less dense in the convex end than in substantially the remainder of the explosive within the hollow case, for increased sensitivity and better and more reliable detonation of the shaped charge.

2. The method of claim 1 further comprising forming an essentially conical convexity.

3. The method of claim 1 further comprising forming the detonating bore entirely through the rear wall of the hollow case.

4. A method for fabricating a shaped charge, comprising:

(a) forming a hollow case having a rear wall and an open end opposite the rear wall, (b) forming a detonating bore through the rear wall of the hollow case, (c) forming a conical, outwardly convex end in the detonating bore, (d) loading explosive powder material into the case substantially only through the open end thereof, and (e) compacting the explosive material within the case into a shaped charge, through the open end thereof and toward and against the rear wall thereof, to cause a portion of the explosive to enter the detonating bore and the convex end thereof and be less compacted and less dense in the convex end than in substantially the remainder of the explosive within the hollow case, for increased sensitivity and better and more reliable detonation of the shaped charge.

5. A method for fabricating a shaped charge, comprising:

(a) forming a charge casing having side wall portions and a rear wall portion defining an inner cavity with a frontal opening therein, (b) forming a detonating bore through the rear wall portion including decreasing the cross-sectional area of the portions of the detonating bore proximate to the inner cavity, (c) loading explosive material into the inner cavity of the casing through the frontal opening.

(d) compacting the explosive material through the frontal opening and toward the rear wall portion thereby defining a shaped charge adjacent the rear wall portion while simultaneously introducing a portion of the explosive material into the detonating bore and beyond the portion of the detonating bore having the decreased cross-sectional area thereby affording an increased area for the explosive material, and (e) at least partially diffusing the explosive material within the increased area so as to lessen the density of the explosive material therein thereby increasing the sensitivity of the shaped charge.

6. The method for fabricating a shaped charge as claimed in claim 5 wherein said forming a detonating bore through said rear wall portion includes gradually decreasing the cross-sectional area of the portions of the detonating bore proximate the inner cavity so as to define a substantially conical tapering along the bore.

7. A shaped charge, comprising:

a charge casing having side wall portions and a rear wall portion defining an inner cavity with a frontal opening therein, wall portions defining a detonating bore through said rear wall portion wherein said bore has a decreasing cross-sectional area proximate to said inner cavity, whereby the loading of explosive material into said inner cavity through said frontal opening and the compacting of the explosive material through said frontal opening and toward said rear wall portion will define a compacted portion of explosive material adjacent said rear wall portion while simultaneously introducing a portion of the explosive material into said detonating bore and beyond said portion of said detonating bore having the decreased cross-sectional area, and whereby the increased area for the explosive material will result in at least a partial dispersion of the explosive material so as to lessen the density of the explosive material therein and thereby increase the sensitivity of the shaped charge.

8. A shaped charge as claimed in claim 7 wherein said detonating bore through said rear wall portion includes a gradually decreasing cross-sectional area proximate the inner cavity so as to define a substantially conical tapering along the portion of said bore proximate said cavity.

* * * * *